US008075272B2

(12) United States Patent
Riaz et al.

(10) Patent No.: US 8,075,272 B2
(45) Date of Patent: Dec. 13, 2011

(54) STEAM TURBINE ROTATING BLADE FOR A LOW PRESSURE SECTION OF A STEAM TURBINE ENGINE

(75) Inventors: Muhammad Saqib Riaz, Niskayuna, NY (US); Dimitrios Stathopoulos, Delmar, NY (US)

(73) Assignee: General Electric Company, Schenectady, NY (US)

( * ) Notice: Subject to any disclaimer, the term of this patent is extended or adjusted under 35 U.S.C. 154(b) by 656 days.

(21) Appl. No.: 12/205,942

(22) Filed: Oct. 14, 2008

(65) Prior Publication Data

US 2010/0092295 A1 Apr. 15, 2010

(51) Int. Cl.
*F01D 5/22* (2006.01)
*F01D 5/14* (2006.01)

(52) U.S. Cl. ..... 416/191; 416/223 R

(58) Field of Classification Search ..... 416/191, 416/192, 223 R, 219 R
See application file for complete search history.

(56) References Cited

U.S. PATENT DOCUMENTS

| | | | | |
|---|---|---|---|---|
| 4,260,331 | A | 4/1981 | Goodwin | |
| 5,067,876 | A | 11/1991 | Moreman, III | |
| 5,174,720 | A | 12/1992 | Gradl | |
| 5,267,834 | A | 12/1993 | Dinh et al. | |
| 5,277,549 | A | 1/1994 | Chen et al. | |
| 5,299,915 | A | 4/1994 | Dinh et al. | |
| 5,393,200 | A | 2/1995 | Dinh et al. | |
| 5,480,285 | A | 1/1996 | Patel et al. | |
| 5,494,408 | A | 2/1996 | Seeley et al. | |
| 5,531,569 | A | 7/1996 | Seeley | |
| 5,829,955 | A | 11/1998 | Saito et al. | |
| 6,142,737 | A | 11/2000 | Seeley et al. | |
| 6,435,833 | B1 | 8/2002 | Reluzco et al. | |
| 6,435,834 | B1 | 8/2002 | Reluzco et al. | |
| 6,499,959 | B1 * | 12/2002 | Reluzco et al. | 416/241 R |
| 6,568,908 | B2 | 5/2003 | Namura et al. | |
| 6,575,700 | B2 | 6/2003 | Arai et al. | |
| 6,652,237 | B2 | 11/2003 | Yehle et al. | |
| 6,682,306 | B2 | 1/2004 | Murakami et al. | |
| 6,814,543 | B2 | 11/2004 | Barb et al. | |
| 6,846,160 | B2 | 1/2005 | Saito et al. | |
| 6,893,216 | B2 | 5/2005 | Snook et al. | |
| 7,097,428 | B2 | 8/2006 | Barb et al. | |
| 7,195,455 | B2 | 3/2007 | Stonitsch et al. | |
| 2002/0057969 | A1 | 5/2002 | Namura et al. | |
| 2003/0049131 | A1 | 3/2003 | Murakami et al. | |

(Continued)

OTHER PUBLICATIONS

Amir Mujezinovic, "Bigger Blades Cut Costs", Modern Power Systems, Feb. 2003, p. 25, 27.

(Continued)

*Primary Examiner* — Stephen Jones
(74) *Attorney, Agent, or Firm* — Hoffman Warnick LLC; Ernest G. Cusick

(57) ABSTRACT

A steam turbine rotating blade for a low pressure section of a steam turbine engine is disclosed. The steam turbine rotating blade includes an airfoil portion. A root section is attached to one end of the airfoil portion. A dovetail section projects from the root section, wherein the dovetail section includes a skewed axial entry dovetail. A tip section is attached to the airfoil portion at an end opposite from the root section. A cover is integrally formed as part of the tip section. A part span shroud is attached at an intermediate section of the airfoil portion between the ends thereof. The blade includes an exit annulus area of about 47.7 $ft^2$ (4.43 $m^2$) or greater.

19 Claims, 4 Drawing Sheets

U.S. PATENT DOCUMENTS

| | | | | |
|---|---|---|---|---|
| 2004/0126235 | A1 | 7/2004 | Barb et al. | |
| 2007/0292265 | A1 | 12/2007 | Burdgick et al. | |
| 2009/0214345 | A1 * | 8/2009 | DeMania et al. | 416/182 |
| 2010/0021306 | A1 | 1/2010 | Mujezinovic et al. | |

OTHER PUBLICATIONS

Michael Boss, "Steam Turbine Technology Heats Up", PEI Magazine, Apr. 2003, p. 77, 79, 81.

Riaz et al., "Dovetail Attachment for Use With Turbine Assemblies and Methods of Assembling Turbine Assemblies," U.S. Appl. No. 11/941,751, filed Nov. 16, 2007, Patent Application, 16 pages.

Slepski et al., "Steam Turbine Rotating Blade," U.S. Appl. No. 11/778,180, filed Jul. 16, 2007, Patent Application, 11 pages.

Demania et al., "Low Pressure Section Steam Turbine Bucket," U.S. Appl. No. 12/037,346, filed Feb. 26, 2008, Patent Application, 15 pages.

Lee, Office Action Communication for U.S. Appl. No. 12/205,940 dated Aug. 11, 2011, 18 pages.

Lee, Office Action Communication for U.S. Appl. No. 12/205,941 dated Aug. 15, 2011, 17 pages.

* cited by examiner

STEAM TURBINE ROTATING BLADE FOR A LOW PRESSURE SECTION OF A STEAM TURBINE ENGINE

CROSS REFERENCE TO RELATED APPLICATIONS

This patent application relates to commonly-assigned U.S. patent applications Ser. No. 12/205,940 entitled "STEAM TURBINE ROTATING BLADE FOR A LOW PRESSURE SECTION OF A STEAM TURBINE ENGINE" and Ser. No. 12/205,941 entitled "STEAM TURBINE ROTATING BLADE FOR A LOW PRESSURE SECTION OF A STEAM TURBINE ENGINE", all filed concurrently with this application.

BACKGROUND OF THE INVENTION

The present invention relates generally to a rotating blade for a steam turbine and more particularly to a rotating blade with optimized geometry capable of increased operating speeds for use in a latter stage of a low pressure section of a steam turbine.

The steam flow path of a steam turbine is generally formed by a stationary casing and a rotor. In this configuration, a number of stationary vanes are attached to the casing in a circumferential array and extend inward into the steam flow path. Similarly, a number of rotating blades are attached to the rotor in a circumferential array and extend outward into the steam flow path. The stationary vanes and rotating blades are arranged in alternating rows so that a row of vanes and the immediately downstream row of blades form a stage. The vanes serve to direct the flow of steam so that it enters the downstream row of blades at the correct angle. Airfoils of the blades extract energy from the steam, thereby developing the power necessary to drive the rotor and the load attached thereto.

As the steam flows through the steam turbine, its pressure drops through each succeeding stage until the desired discharge pressure is achieved. Thus, steam properties such as temperature, pressure, velocity and moisture content vary from row to row as the steam expands through the flow path. Consequently, each blade row employs blades having an airfoil shape that is optimized for the steam conditions associated with that row.

In addition to steam conditions, the blades are also designed to take into account centrifugal loads that are experienced during operation. In particular, high centrifugal loads are placed on the blades due to the high rotational speed of the rotor which in turn stress the blades. Reducing stress concentrations on the blades is a design challenge, especially in the latter rows of a low pressure section of a steam turbine where the blades are larger and weigh more due to the large size and are subject to stress corrosion due to moisture in the steam flow.

This challenge associated with designing rotating blades for the low pressure section of the turbine is exacerbated by the fact that the airfoil shape of the blades generally determines the forces imposed on the blades, the mechanical strength of the blades, the resonant frequencies of the blades, and the thermodynamic performance of the blades. These considerations impose constraints on the choice of the airfoil shape of the blades. Therefore, the optimum airfoil shape of the blades for a given row is a matter of compromise between mechanical and aerodynamic properties associated with the shape.

BRIEF DESCRIPTION OF THE INVENTION

In one aspect of the present invention, a steam turbine rotating blade is provided. The rotating blade comprises an airfoil portion. A root section is attached to one end of the airfoil portion. A dovetail section projects from the root section, wherein the dovetail section comprises a skewed axial entry dovetail. A tip section is attached to the airfoil portion at an end opposite from the root section. A cover is integrally formed as part of the tip section. A part span shroud is attached at an intermediate section of the airfoil portion between the ends thereof. The blade comprises an exit annulus area of about 47.7 $ft^2$ (4.43 $m^2$) or greater.

In another aspect of the present invention, a low pressure turbine section of a steam turbine is provided. In this aspect of the present invention, a plurality of latter stage steam turbine blades are arranged about a turbine rotor wheel. Each of the plurality of latter stage steam turbine blades comprises an airfoil portion having a length of about 26.8 inches (68.1 centimeters) or greater. A root section is attached to one end of the airfoil portion. A dovetail section projects from the root section, wherein the dovetail section comprises a skewed axial entry dovetail. A tip section is attached to the airfoil portion at an end opposite from the root section. A cover is integrally formed as part of the tip section. A part span shroud is attached at an intermediate section of the airfoil portion between the ends thereof. The plurality of latter stage steam turbine blades comprises an exit annulus area of about 47.7 $ft^2$ (4.43 $m^2$) or greater.

DETAILED DESCRIPTION OF THE INVENTION

At least one embodiment of the present invention is described below in reference to its application in connection with and operation of a steam turbine engine. Further, at least one embodiment of the present invention is described below in reference to a nominal size and including a set of nominal dimensions. However, it should be apparent to those skilled in the art and guided by the teachings herein that the present invention is likewise applicable to any suitable turbine and/or engine. Further, it should be apparent to those skilled in the art and guided by the teachings herein that the present invention is likewise applicable to various scales of the nominal size and/or nominal dimensions.

Figure 1:
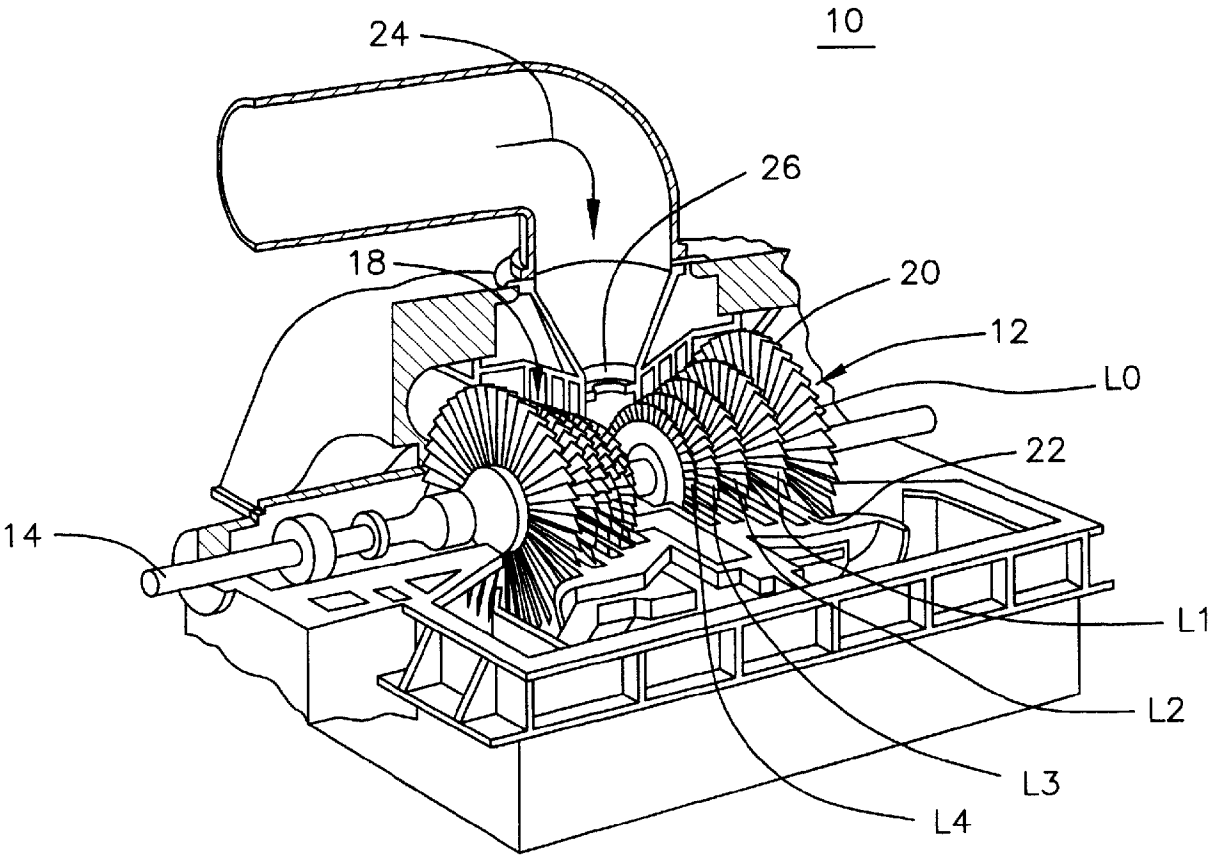
FIG. 1 is a perspective partial cut-away illustration of a steam turbine.

Referring to the drawings, FIG. 1 shows a perspective partial cut-away illustration of a steam turbine 10. The steam turbine 10 includes a rotor 12 that includes a shaft 14 and a plurality of axially spaced rotor wheels 18. A plurality of rotating blades 20 are mechanically coupled to each rotor wheel 18. More specifically, blades 20 are arranged in rows that extend circumferentially around each rotor wheel 18. A plurality of stationary vanes 22 extends circumferentially around shaft 14 and are axially positioned between adjacent rows of blades 20. Stationary vanes 22 cooperate with blades 20 to form a turbine stage and to define a portion of a steam flow path through turbine 10.

In operation, steam 24 enters an inlet 26 of turbine 10 and is channeled through stationary vanes 22. Vanes 22 direct steam 24 downstream against blades 20. Steam 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine. Accordingly, a large steam turbine unit may actually include several turbines that are all co-axially coupled to the same shaft 14. Such a unit may, for example, include a high pressure turbine coupled to an intermediate-pressure turbine, which is coupled to a low pressure turbine.

In one embodiment of the present invention and shown in FIG. 1, turbine 10 comprise five stages. The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, and a low pressure turbine can have more or less than five stages.

Figure 2:
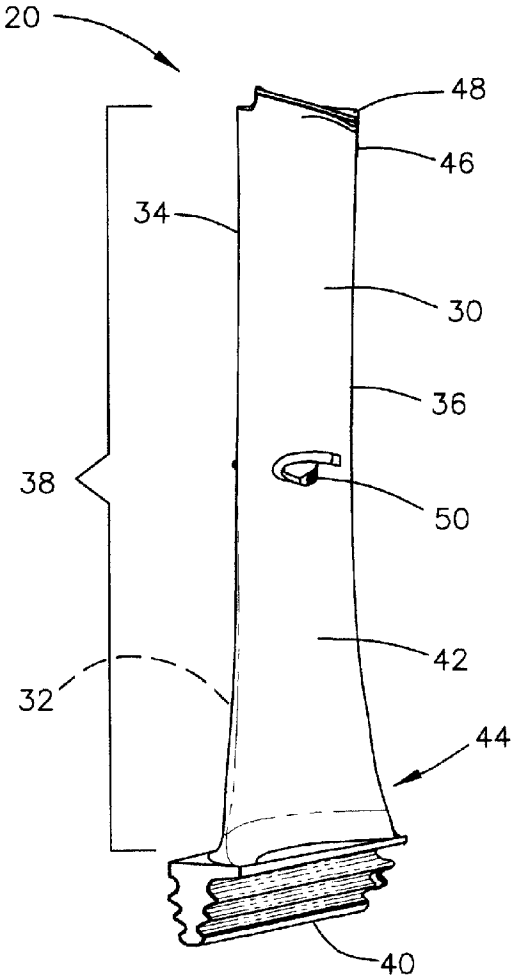
FIG. 2 is a perspective illustration of a steam turbine rotating blade according to one embodiment of the present invention.

FIG. 2 is a perspective illustration of a steam turbine rotating blade 20 according to one embodiment of the present invention. Blade 20 includes a pressure side 30 and a suction side 32 connected together at a leading edge 34 and a trailing edge 36. A blade chord distance is a distance measured from trailing edge 36 to leading edge 34 at any point along a radial length 38. In an exemplary embodiment, radial length 38 or blade length is approximately 26.8 inches (68.1 centimeters). Although the blade length in the exemplary embodiment is approximately 26.8 inches (68.1 centimeters), those skilled in the art will appreciate that the teachings herein are applicable to various scales of this nominal size. For example, one skilled in the art could scale blade 20 by a scale factor such as 1.2, 2 and 2.4, to produce a blade length of 32.22 (81.8 centimeters), 53.7 (136.4 centimeters) and 64.44 (163.7 centimeters), respectively.

Blade 20 is formed with a dovetail section 40, an airfoil portion 42, and a root section 44 extending therebetween. Airfoil portion 42 extends radially outward from root section 44 to a tip section 46. A cover 48 is integrally formed as part of tip section 46. A part span shroud 50 is attached at an intermediate section of airfoil portion 42 between root section 44 and tip section 46. In an exemplary embodiment, dovetail section 40, airfoil portion 42, root section 44, tip section 46, cover 48 and part span shroud 50 are all fabricated as a unitary component from a 12% chrome stainless steel material. In the exemplary embodiment, blade 20 is coupled to turbine rotor wheel 18 (shown in FIG. 1) via dovetail section 40 and extends radially outward from rotor wheel 18.

Figure 3:
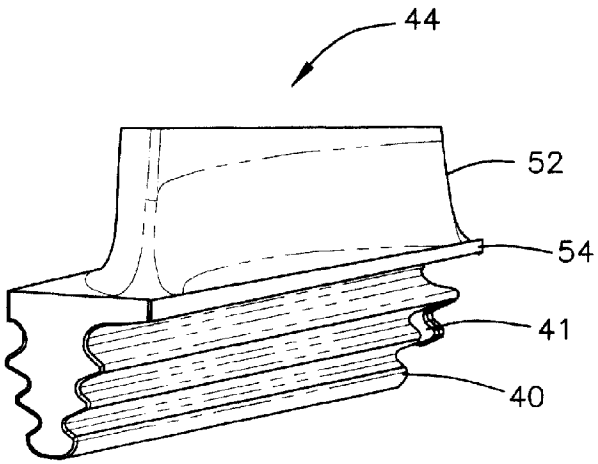
FIG. 3 is an enlarged, perspective illustration of an axial entry dovetail shown in the blade of FIG. 2 according to one embodiment of the present invention.

FIG. 3 is an enlarged, perspective illustration of dovetail section 40 shown in the blade of FIG. 2 according to one embodiment of the present invention. In this embodiment, dovetail section 40 comprises a skewed axial entry dovetail having about a 19 degree skew angle that engages a mating slot defined in the turbine rotor wheel 18 (shown in FIG. 1). In one embodiment, the skewed axial entry dovetail includes a three hook design having six contact surfaces configured to engage with turbine rotor wheel 18 (shown in FIG. 1). The skewed axial entry dovetail is preferable in order to obtain a distribution of average and local stresses, protection during over-speed conditions and adequate low cycle fatigue (LCF) margins, as well as accommodate airfoil root section 44. FIG. 3 also shows that dovetail section 40 includes an axial retention hook 41 that prevents axial movement in blade 20. Those skilled in the art will recognize that the skewed axial entry dovetail can have more or less than three hooks. Commonly-assigned U.S. patent application Ser. No. 11/941,751 entitled "DOVETAIL ATTACHMENT FOR USE WITH TURBINE ASSEMBLIES AND METHODS OF ASSEMBLING TURBINE ASSEMBLIES" provides a more detailed discussion of a skewed axial entry dovetail.

In addition to providing further details of dovetail section 40, FIG. 3 also shows an enlarged view of a transition area where the dovetail section 40 projects from the root section 44. In particular, FIG. 3 shows a fillet radius 52 at the location where root section 44 transitions to a platform 54 of the dovetail section. In an exemplary embodiment, fillet radius 52 comprises multiple radii that blends airfoil portion 42 with platform 54.

Figure 4:
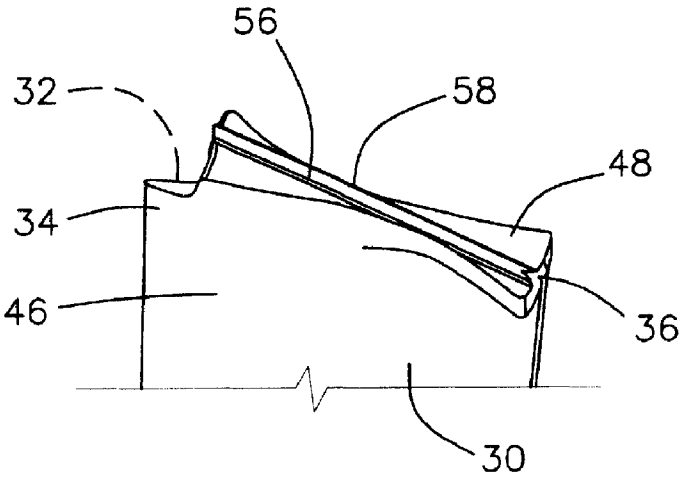
FIG. 4 is a perspective illustration of a cover that is used with the blade of FIG. 2 according to one embodiment of the present invention.

FIG. 4 is a perspective illustration of tip section 46 and cover 48 according to one embodiment of the present invention. Cover 48 improves the stiffness and damping characteristics of blade 20. A seal tooth 56 can be placed on the outer surface of cover 48. Seal tooth 56 functions as a sealing means to limit steam flow past the outer portion of blade 20. Seal tooth 56 can be a single rib or formed of multiple ribs, a plurality of straight or angled teeth, or one or more teeth of different dimensions (e.g., a labyrinth type seal).

As shown in FIG. 4, cover 48 comprises a flat section that extends away from leading edge 34 at a predetermined distance therefrom to trailing edge 36. Cover 48 has a width that narrows substantially from the end located at the predetermined distance away from leading edge 34 to a location that is in a substantially central location 58 with respect to trailing edge 36 and leading edge 34. The width of cover 48 increases from central location 58 to trailing edge 36. The width of cover 48 at the end located at the predetermined distance away from leading edge 34 and the width of cover 48 at trailing edge 36 are substantially similar. FIG. 4 further shows that seal tooth 56 projects upward from cover 48, wherein seal tooth 56 extends from the end located at the predetermined distance away from leading edge 34 through substantially central location 58 to trailing edge 36. FIG. 4 also shows that cover 48 extends over suction side 32 at the end located at the predetermined distance away from leading edge 34 to about central location 58 and cover 48 extends over pressure side 30 from central location 58 to trailing edge 36.

Figure 5:
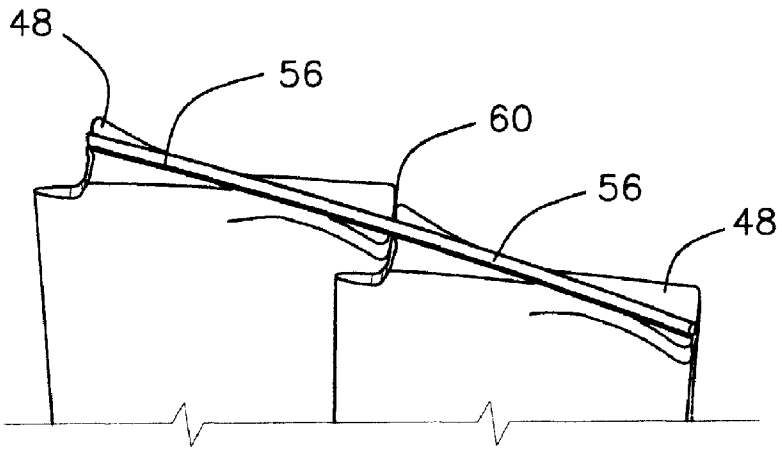
FIG. 5 is a perspective illustration showing the interrelation of adjacent covers according to one embodiment of the present invention.

FIG. 5 is a perspective illustration showing the interrelation of adjacent covers 48 according to one embodiment of the present invention. In particular, FIG. 5 illustrates an initially assembled view of covers 48. Covers 48 are designed to have a gap 60 between adjacent covers 48, during initial assembly and/or at zero speed conditions. As can be seen, seal tooth 56 are also slightly misaligned in the zero-rotation condition. As turbine rotor wheel 18 (shown in FIG. 1) is rotated, blades 20 begin to untwist. As the revolution per minutes (RPM) of blades 20 approach the operating level, the blades untwist due to centrifugal force, the gaps 60 close and the seal tooth 56 becomes aligned with each other so that there is nominal gap with adjacent covers and blades 20 form a single continuously coupled structure. The interlocking covers provide improved blade stiffness, improved blade damping, and improved sealing at the outer radial positions of blades 20.

In an exemplary embodiment, the operating level for blades 20 is 3600 RPM, however, those skilled in the art will appreciate that the teachings herein are applicable to various scales of this nominal size. For example, one skilled in the art could scale the operating level by a scale factors such as 1.2, 2 and 2.4, to produce blades that operate at 3000 RPM, 1800 RPM and 1500 RPM, respectively.

Figure 6:
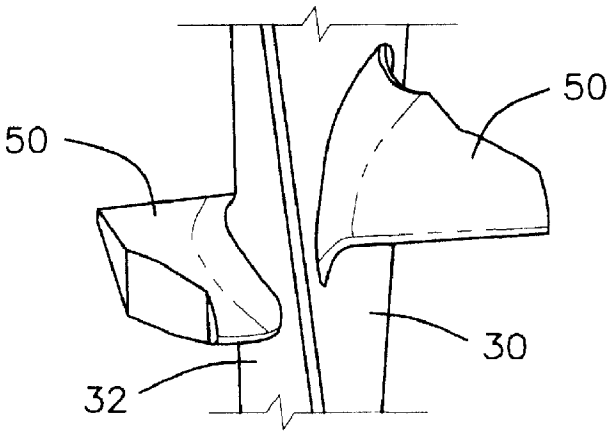
FIG. 6 is a perspective illustration of part span shrouds that are used with the blade of FIG. 2 according to one embodiment of the present invention.

FIG. 6 is a perspective illustration of part span shrouds 50 that are used according to one embodiment of the present invention. As shown in FIG. 6, part span shrouds 50 are located on the pressure side 30 and suction side 32 of blade 20. In this embodiment, part span shrouds 50 are triangular in shape and project outwardly from pressure side 30 and suction side 32.

Figure 7:
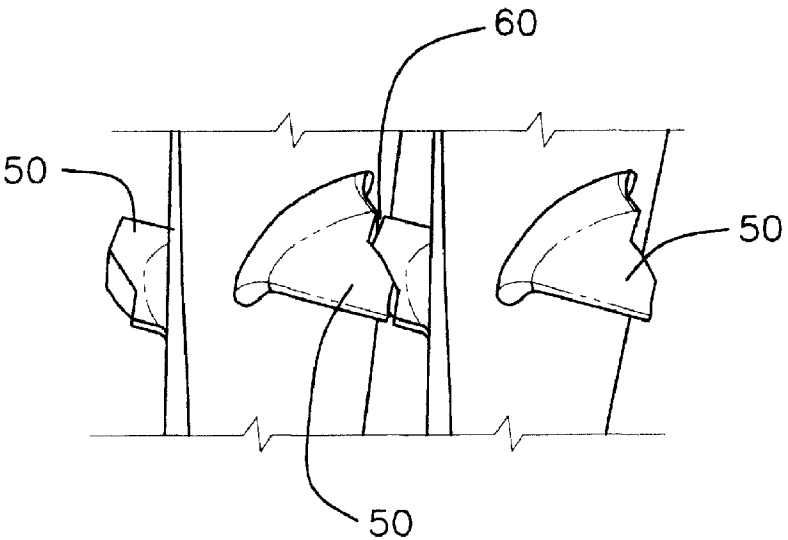
FIG. 7 is a perspective illustration showing the interrelation of adjacent part span shrouds according to one embodiment of the present invention.

FIG. 7 is a perspective illustration showing the interrelation of adjacent part span shrouds 50 according to one embodiment of the present invention. During zero-speed conditions, a gap 62 exists between adjacent part span shrouds 50 of neighboring blades. This gap 62 is closed as the turbine rotor wheel 18 (shown in FIG. 1) begins to rotate while approaching operating speed and as the blades untwist. Part span shrouds 50 are aerodynamically shaped to reduce windage losses and improve overall efficiency. The blade stiffness and damping characteristics are also improved as part span shrouds 50 contact each other during blade untwist. As the blades untwist, covers 48 and part span shrouds 50 contact their respective neighboring shrouds. The plurality of blades 20 behave as a single, continuously coupled structure that exhibits improved stiffness and dampening characteristics when compared to a discrete and uncoupled design. An additional advantage is blade 20 exhibits reduced vibratory stresses.

The blade according to aspects of the present invention is preferably used in the last or L0 stage of a low pressure section of a steam turbine. However, the blade could also be used in other stages or other sections (e.g., high or intermediate) as well. As mentioned above, one preferred blade length for blade 20 is about 26.8 inches (68.1 centimeters). This blade length can provide a last stage exit annulus area of about 47.7 $ft^2$ (4.43 $m^2$). This enlarged and improved exit annulus area can decrease the loss of kinetic energy the steam experiences as it leaves the last stage L0 blades. This lower loss provides increased turbine efficiency.

As noted above, those skilled in the art will recognize that if the blade length is scaled to another blade length then this scale will result in an exit annulus area that is also scaled. For example, if scale factors such as 1.2, 2 and 2.4 were used to generate a blade length of 32.22 (81.8 centimeters), 53.7 (136.4 centimeters) and 64.44 (163.7 centimeters), respectively, then an exit annulus area of about 68.6 $ft^2$ (6.4 $m^2$), 190.6 $ft^2$ (17.7 $m^2$), and 274.5 $ft^2$ (25.5 $m^2$) would result, respectively.

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A steam turbine rotating blade, comprising:

an airfoil portion;

a root section attached to one end of the airfoil portion;

a dovetail section projecting from the root section, wherein the dovetail section comprises a skewed axial entry dovetail, wherein the skewed axial entry dovetail comprises about a 19 degree skew angle;

a tip section attached to the airfoil portion at an end opposite from the root section;

a cover integrally formed as part of the tip section;

a part span shroud attached at an intermediate section of the airfoil portion between the ends thereof; and wherein the blade comprises an exit annulus area of about 47.7 $ft^2$ (4.43 $m^2$) or more.

2. The steam turbine rotating blade according to claim 1, wherein the skewed axial entry dovetail comprises a three hook design having six contact surfaces configured to engage with a turbine rotor wheel.

3. The steam turbine rotating blade according to claim 1, wherein the blade has an operating speed that ranges from about 1500 revolutions per minute to about 3600 revolutions per minute.

4. The steam turbine rotating blade according to claim 1, wherein the airfoil portion comprises a length of about 26.8 inches (68.1 centimeters) or greater.

5. The steam turbine rotating blade according to claim 1, wherein the blade operates as a latter stage blade of a low pressure section of a steam turbine.

6. The steam turbine rotating blade according to claim 1, wherein the blade comprises a 12% chrome stainless steel material.

7. The steam turbine rotating blade according to claim 1, further comprising a first fillet radius located at a first transition area where the dovetail section projects from the root section.

8. The steam turbine rotating blade according to claim 1, wherein the part span shroud is triangular in shape and projects outwardly from the airfoil portion at a pressure side of the airfoil portion and a suction side of the airfoil portion.

9. The steam turbine rotating blade according to claim 1, wherein the cover comprises a flat section that extends away from a leading edge of the airfoil portion at a predetermined distance therefrom to a trailing edge of the airfoil portion, the cover having a width that narrows substantially from an end located at the predetermined distance away from the leading edge to a location that is in a substantially central location with respect to the trailing edge and leading edge, the width of the cover increasing from the central location to the trailing edge, wherein the width of the cover at the end located at the predetermined distance away from the leading edge and the width of the cover at the trailing edge are substantially similar.

10. The steam turbine rotating blade according to claim 9, further comprising a seal tooth that projects upward from the cover, wherein the seal tooth extends from the end located at the predetermined distance away from the leading edge through the substantially central location to the trailing edge.

11. The steam turbine rotating blade according to claim 9, wherein the cover extends over a suction side of the airfoil portion at the end located at the predetermined distance away from the leading edge to about the central location, the cover extending over a pressure side of the airfoil portion from the central location to the trailing edge.

12. A low pressure turbine section of a steam turbine, comprising:

a plurality of latter stage steam turbine blades arranged about a turbine rotor wheel, wherein each of the plurality of latter stage steam turbine blades comprises:

an airfoil portion having a length of about 26.8 inches (68.1 centimeters) or greater;

a root section attached to one end of the airfoil portion;

a dovetail section projecting from the root section, wherein the dovetail section comprises a skewed axial entry dovetail, wherein the skewed axial entry dovetail comprises about a 19 degree skew angle;

a tip section attached to the airfoil at an end opposite from the root section;

a cover integrally formed as part of the tip section;

a part span shroud attached at an intermediate section of the airfoil portion between the ends thereof; and wherein the plurality of latter stage steam turbine blades comprises an exit annulus area of about 47.7 $ft^2$ (4.43 $m^2$) or greater.

13. The low pressure turbine section according to claim 12, wherein the plurality of latter stage steam turbine blades operate at a speed that ranges from about 1500 revolutions per minute to about 3600 revolutions per minute.

14. The low pressure turbine section according to claim 12, wherein the skewed axial entry dovetail comprises a three hook design having six contact surfaces configured to engage with the turbine rotor wheel.

15. The low pressure turbine section according to claim 12, wherein the covers of the plurality of latter stage steam turbine blades are assembled with a nominal gap with adjacent covers.

16. The low pressure turbine section according to claim 12, wherein the covers of the plurality of latter stage steam turbine blades form a single continuously coupled structure.

17. The low pressure turbine section according to claim 12, wherein the part span shrouds for each of the plurality of latter stage steam turbine blades are configured to have a gap therebetween, wherein the gap is closed as the plurality of latter stage steam turbine blades reaches a predetermined operational speed.

18. The low pressure turbine section according to claim 12, wherein the cover comprises a flat section that extends away from a leading edge of the airfoil portion at a predetermined distance therefrom to a trailing edge of the airfoil portion, the cover having a width that narrows substantially from an end located at the predetermined distance away from the leading edge to a location that is in a substantially central location with respect to the trailing edge and leading edge, the width of the cover increasing from the central location to the trailing edge, wherein the width of the cover at the end located at the predetermined distance away from the leading edge and the width of the cover at the trailing edge are substantially similar, and wherein the cover extends over a suction side of the airfoil portion at the end located at the predetermined distance away from the leading edge to about the central location, the cover extending over a pressure side of the airfoil portion from the central location to the trailing edge.

19. The low pressure turbine section according to claim 18, further comprising a seal tooth that projects upward from the cover, wherein the seal tooth extends from the end located at the predetermined distance away from the leading edge through the substantially central location to the trailing edge.

* * * * *